United States Patent [19]

Lanz et al.

[11] 4,074,449

[45] Feb. 21, 1978

[54] METHOD OF MAKING A LOADER BUCKET CUTTING EDGE WITH RECESSED BOLT STUDS

[75] Inventors: William E. Lanz, Joliet; Visvaldis A. Stepe, Willow Springs, both of Ill.

[73] Assignee: Caterpillar Tractor Co., Peoria, Ill.

[21] Appl. No.: 795,357

[22] Filed: May 9, 1977

Related U.S. Application Data

[62] Division of Ser. No. 733,689, Oct. 18, 1976, Pat. No. 4,052,803.

[51] Int. Cl.[2] ..... E02F 9/28; A01B 35/26

[52] U.S. Cl. ..... 37/141 R; 76/101 R; 172/745

[58] Field of Search ..... 37/141 R, 141 T, 142 R, 37/142 A, 195; 172/745; 219/97, 98, 99, 117 R; 29/DIG. 48; 228/2, 113; 76/1, 101 R

[56] References Cited

U.S. PATENT DOCUMENTS

| | | | |
|---|---|---|---|
| 2,220,819 | 11/1940 | Johnson | 37/141 R |
| 3,273,233 | 9/1966 | Oberle et al. | 228/2 X |
| 3,323,203 | 6/1967 | Hollander et al. | 228/2 X |
| 3,497,973 | 3/1970 | Campbell | 37/141 R |
| 3,576,067 | 4/1971 | Loyd et al. | 228/2 |
| 3,616,980 | 11/1971 | Padilla | 228/2 |
| 3,671,710 | 6/1972 | Coombs | 219/99 |
| 3,995,384 | 12/1976 | Wood | 37/141 R |

FOREIGN PATENT DOCUMENTS

| | | | |
|---|---|---|---|
| 865,840 | 4/1961 | United Kingdom | 37/142 A |

*Primary Examiner*—E. H. Eickholt
*Attorney, Agent, or Firm*—Phillips, Moore, Weissenberger, Lempio & Majestic

[57] ABSTRACT

A loader bucket comprises a bottom wall having an elongated general purpose edge disposed forwardly thereon. A reversible cutting edge is bolted onto an underside of the general purpose edge, along with a plurality of laterally spaced adapters each having a hardened earthworking tip detachably mounted thereon. In a first embodiment of this invention, a plurality of laterally spaced bores are formed to a limited depth on the upper side of the cutting edge and the lower end of a bolt stud is welded within each bore. The stud extends upwardly through aligned holes formed through the cutting edge and the adapter to have a nut threaded on the upper end thereof. In a second embodiment of this invention, a continuous slot is formed along the cutting edge to receive the studs therein. Alternatively, the bores or slot may be formed on an underside of the general purpose edge. In carrying forth the method steps of this invention, the studs are flash welded to the upper side of the cutting edge prior to assembly thereof on the bucket.

5 Claims, 7 Drawing Figures

Fig-4-
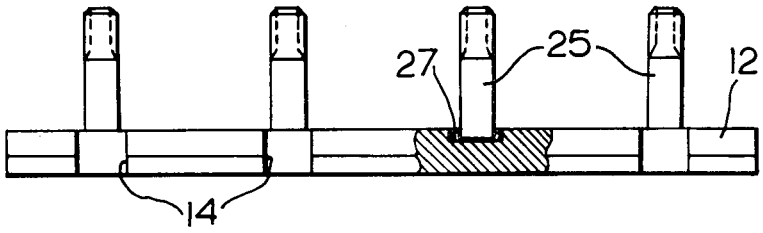
Fig-6-
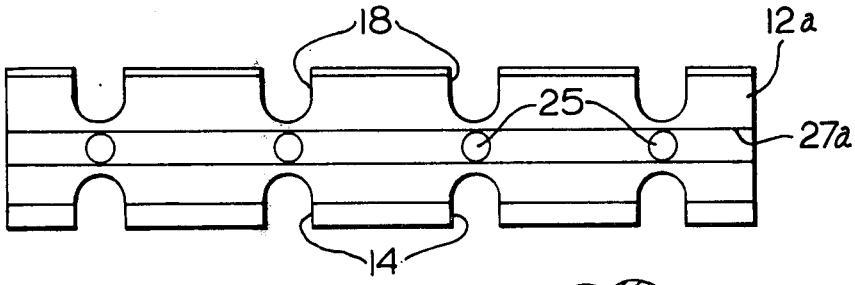
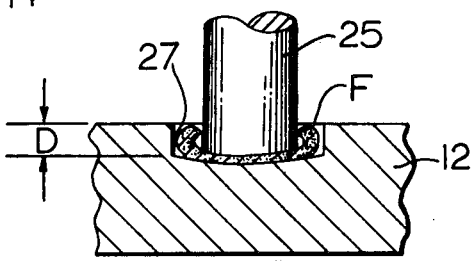
Fig-7-
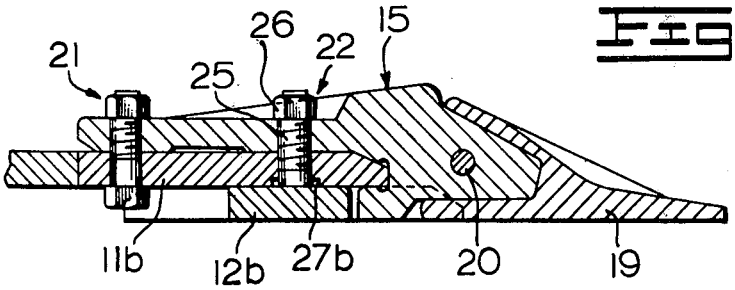
Fig-5-

METHOD OF MAKING A LOADER BUCKET CUTTING EDGE WITH RECESSED BOLT STUDS

This is a division of Ser. No. 733,689, filed Oct. 18, 1976 now U.S. Pat. No. 4,052,803.

BACKGROUND OF THE INVENTION

This invention relates to a work implement, such as a loader bucket, having a cutting edge detachably mounted thereon. A conventional loader bucket normally comprises a cutting edge secured forwardly on a bottom wall thereof for performing various clean-up operations. In certain work applications, a plurality of laterally spaced adapters and hardened earthworking tips are mounted on the cutting edge for digging and like earthworking operations.

The substantial loads imposed on the tips make it imperative that the cutting edge and adapters be firmly secured to the bucket to prevent dislodgement thereof. One of the problems encountered with such an arrangement is that the bolts, releasably attaching the cutting edge and adapters to the bucket, are exposed on an underside of the bucket. Thus, the exposed bolts are prone to wear and require periodic replacement.

SUMMARY OF THIS INVENTION

An object of this invention is to provide an improved detachable cutting edge and tip-adapter arrangement for a work implement, such as a loader bucket. The work implement comprises an elongated and flat general purpose edge disposed forwardly thereon. A flat cutting edge is mounted beneath the general purpose edge to be substantially coextensive therewith and has a forward edge defined thereon.

A plurality of fastening means, releasably securing the cutting edge on the general purpose edge, each comprise a fastening stud having a lower end thereof secured on an upper side of the cutting edge and extending upwardly through a hole formed through the cutting edge. A recess is defined in either the general purpose edge or the cutting edge which circumvents the lower end of the fastening stud to accommodate a welding flash therein. In one embodiment, an individual circular recess is formed on an upper side of the cutting edge to accommodate the lower end of each fastening stud. In a second embodiment, the recess constitutes an elongated groove formed along the upper side of the cutting edge to accommodate the lower ends of the fastening studs therein. Alternatively, the circular recesses or slot may be defined on an underside of the general purpose edge.

In carrying forth the method steps of this invention, the fastening studs are flash welded, preferably by friction welding, to the upper side of the cutting edge prior to assembly thereof on the bucket. Upon such assembly, the above-described recesses will each accommodate the lower end of a respective fastening stud and the flash formed therearound, i.e., the depth of the recess is no greater than the thickness of the weld flash.

BRIEF DESCRIPTION OF THE DRAWINGS

Further objects of this invention will become apparent from the following description and accompanying drawings wherein:

FIG. 4 is a front elevational view of the cutting edge, having the fastening studs secured thereon, partially sectioned for clarification purposes;

FIG. 5 is an enlarged view illustrating the lower end of one fastening stud welded within a recess defined in the cutting edge;

FIG. 6 is a view similar to FIG. 3, but illustrating a modification of the cutting edge; and FIG. 7 is a view similar to FIG. 2, but illustrating a further modification of this invention.

DETAILED DESCRIPTION

Figure 1:
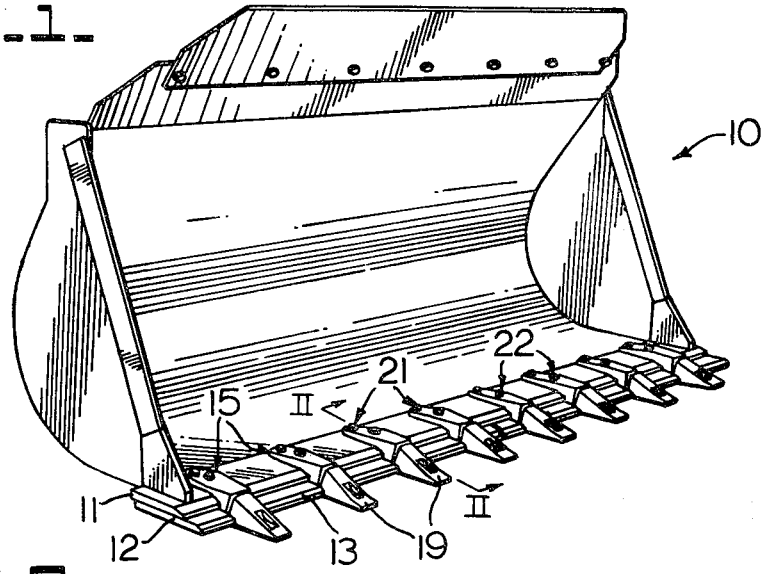
FIG. 1 is a front perspective view of a loader bucket employing the detachable cutting edge arrangement of this invention thereon.

FIG. 1 illustrates a loader bucket 10 having an elongated and flat general purpose edge 11 disposed forwardly thereon and secured to the bottom wall of the bucket. A flat cutting edge 12 is mounted beneath the general purpose edge to be substantially coextensive therewith laterally. The cutting edge has a forward edge 13 projecting forwardly therefrom and a plurality of first U-shaped and laterally spaced notches 14 formed therethrough (FIGS. 2 and 3).

Figure 2:
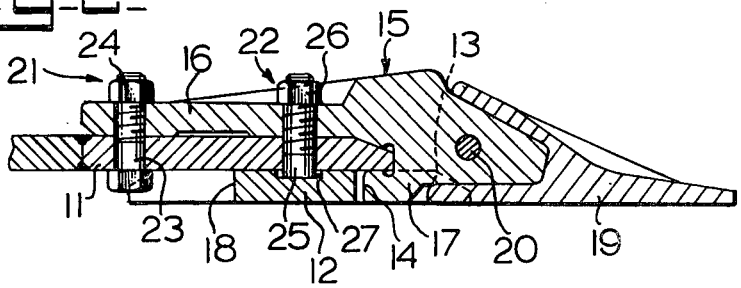
FIG. 2 is an enlarged sectional view, taken in the direction of arrows II—II in FIG. 1.
Figure 3:
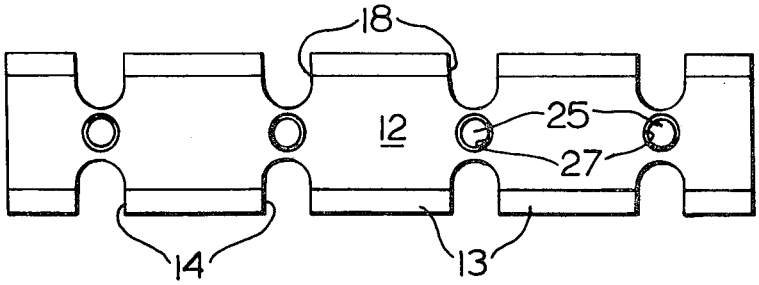
FIG. 3 is a top plan view of a reversible cutting edge employed in the loader bucket and having a plurality of fastening studs secured thereon.

A plurality of laterally spaced adapters 15 are each mounted in straddling relationship on general purpose edge 11, as more clearly shown in FIG. 2. In particular, each adapter comprises an upper portion 16 extending rearwardly substantially over the full width of general purpose edge 11 and a lower portion 17 extending rearwardly under the forward edge thereof. Adapter portions 16 and 17 thus cooperate to prevent the adapter from moving vertically relative to the general purpose and cutting edges.

In its illustrated assembled condition, the rearward end of lower portion 17 of the adapter has a U-shape conforming to the shape of a respective notch 14 to be fully accommodated therein. The cutting edge is symmetrical and reversible in that it has a second set of U-shaped notches 18 formed through a rearward edge thereof and disposed in alignment with the first set of notches 14. Although the cutting edge is shown to constitute one-piece, it should be understood that it can be fabricated in two or more aligned sections.

As further shown in FIG. 2, a substantially flush and co-planar relationship is maintained across the bottom surfaces of cutting edge 12, lower portion 17 of the adapter and a hardened earthworking tooth or tip 19. The tip is secured on the adapter by standard lock pin 20. Such flush relationship induces a smooth flow of material into the bucket, deters loose cutting materials from slipping thereunder which might cause excessive tire wear and also aids in grading and finishing work, for example.

The cutting edge and adapters are releasably secured to general purpose edge 11 by a plurality of first and second fastening means 21 and 22, respectively. As further shown in FIG. 2, each first fastening means 21 comprises a bolt 23 extending upwardly through aligned holes formed through the general purpose edge and a respective adapter 15. A nut 24 is threadably attached on an upper end of the bolt and the head end of the bolt is disposed in a respective notch 18 to protect the same.

The crux of this invention centers around the construction and arrangement of second fastening means 22. Each fastening means comprises a fastener or bolt stud 25 having a lower end thereof secured, preferably by welding, to an upper side of cutting edge 12. The stud extends upwardly through a pair of aligned holes formed through general purpose edge 11 and upper portion 16 of a respective adapter 15 and has a nut 26 threadably attached on an upper end thereof. As more clearly shown in FIGS. 2 and 3, the lower end of each stud is disposed in a circular recess or bore 27 which is aligned axially with the holes formed through the cutting edge and adapter to receive the stud therein.

Referring to FIGS. 4 and 5, the lower end of each stud is welded within a respective recess 27 to form a flash F. Depth D of each recess 27 is greater than the thickness of flash F to provide a flush relationship between the engaging surfaces of generally purpose edge 11 and cutting edge 12, when the cutting edge is assembled in place (FIG. 2). The stud is preferably friction welded in place by rotating the lower end of the stud against the cutting edge to provide a metallic bond therebetween, as taught in U.S. Pat. No. 3,273,233, for example.

FIG. 6 illustrates a modified cutting edge 12*a* wherein corresponding structures are depicted by identical numerals, but with numerals depicting modified constructions being accompanied by an "*a*". In essence, the recess for accommodating the lower end of each stud 25 has been modified to comprise a continuous elongated slot 27*a* formed along the entire length of the cutting edge. The lower ends of the studs may be placed in a suitable fixture to space them accurately along the cutting edge and are thereafter welded in place within recess 27*a*, as explained above.

FIG. 7 illustrates a further modification of this invention wherein corresponding structures are depicted by identical numerals, but with numerals depicting modified constructions being accompanied by a "*b*". Comparing FIGS. 2 and 7, it should be noted that a recess 27*b* is defined on an underside of general purpose edge 11 rather than on the upper side of cutting edge 12*b*. The recess may comprise the laterally spaced individual and circular recesses or counterbores 27 illustrated in FIG. 3 or an elongated slot of the type illustrated at 27*a* in FIG. 6. The lower end of each stud 25 is welded to an upper flat and uninterrupted side of the cutting edge, in the same manner as explained above, and the flash accruing therefrom would be confined within recess 27*b* to assure intimate contact between the general purpose edge and the cutting edge. Alternatively, such flash accommodating recess could be formed on the upper side of the cutting edge (FIG. 2) and also on the underside of the general purpose edge (FIG. 7).

What is claimed is:

1. A method for forming a cutting edge for use on a loader bucket or the like comprising the steps of forming at least one recess on said cutting edge, positioning a lower end of a fastening stud in said recess, and welding the lower end of said fastening stud to said cutting blade.

2. The method of claim 1 wherein said welding step comprises friction welding said fastening stud to said cutting edge by rotating said fastening stud relative to said cutting edge and engaging the same to create a metallic bond therebetween.

3. The method of claim 2 wherein said welding step further comprises creating a flash and disposing said flash entirely within said recess.

4. The method of claim 1 wherein said forming step comprises forming a plurality of individual and circular recesses on an upper side of said cutting edge and wherein said welding step comprises welding the lower end of a said fastening stud in each of said recesses.

5. The method of claim 1 wherein said forming step comprises forming said recess as an elongated single slot along said cutting edge and wherein said welding step comprises welding the lower ends of a plurality of fastening studs in said slot.

* * * * *